United States Patent [19]

Cline et al.

[11] Patent Number: 4,774,044

[45] Date of Patent: Sep. 27, 1988

[54] FLAME RETARDANT POLYOLEFIN FIBER

[75] Inventors: Bobby L. Cline; Gerard M. O'Mahony, both of Dalton, Ga.

[73] Assignee: Techlon Fibers Corporation, Dalton, Ga.

[21] Appl. No.: 880,956

[22] Filed: Jun. 26, 1986

Related U.S. Application Data

[63] Continuation-in-part of Ser. No. 808,188, Dec. 12, 1985, abandoned.

[51] Int. Cl.[4] ..... D01F 8/10

[52] U.S. Cl. ..... 264/210.6; 264/211; 524/291; 524/371; 524/412; 523/351

[58] Field of Search ..... 264/211, 210.6; 523/351; 524/410, 371, 291, 412; 428/95, 96

[56] References Cited

U.S. PATENT DOCUMENTS

| | | | |
|---|---|---|---|
| 2,480,298 | 8/1949 | Happoldt | 524/411 |
| 3,006,787 | 10/1961 | Blewis et al. | 117/232 |
| 3,275,591 | 9/1966 | Tomlinson | 523/351 |
| 3,480,582 | 11/1969 | Brooks | 260/45.75 |
| 3,576,784 | 4/1971 | Gloor | 260/45.75 |
| 3,650,300 | 3/1972 | Listner | 139/420 |
| 3,694,402 | 9/1972 | Essam | 523/206 |
| 3,833,540 | 9/1974 | Anderson | 260/45.9 R |
| 3,839,140 | 10/1974 | Tyler et al. | 161/175 |
| 3,860,676 | 1/1975 | Krackeler et al. | 260/897 B |
| 3,883,481 | 5/1975 | Kopetz et al. | 260/45.75 B |
| 3,927,145 | 12/1975 | Gaeckel et al. | 260/897 B |
| 3,960,806 | 6/1976 | Najour | 260/40 P |
| 3,976,722 | 8/1976 | Carlson | 260/880 R |
| 3,988,296 | 10/1976 | Bethea et al. | 260/45.75 B |
| 3,988,363 | 10/1976 | Spivack et al. | 260/473 S |
| 3,989,531 | 11/1976 | Orlando et al. | 106/15 FP |
| 3,997,505 | 12/1976 | Albright | 524/119 |
| 4,032,508 | 6/1977 | Anderson | 260/45.75 R |
| 4,033,932 | 7/1977 | Anderson | 260/45.75 B |
| 4,038,248 | 7/1977 | Anderson | 260/45.75 R |
| 4,044,073 | 8/1977 | Baron et al. | 524/371 |
| 4,072,652 | 2/1978 | Anderson | 260/45.75 B |
| 4,073,772 | 2/1978 | Anderson | 260/45.75 B |
| 4,075,146 | 2/1978 | Kiss | 260/23 H |
| 4,082,725 | 4/1978 | Anderson | 260/45.75 B |
| 4,085,132 | 4/1978 | Park et al. | 560/75 |
| 4,089,912 | 5/1978 | Levek et al. | 260/862 |
| 4,094,858 | 6/1978 | Anderson | 260/45.75 B |
| 4,102,850 | 7/1978 | Cooper et al. | 260/33.6 |
| 4,116,908 | 9/1978 | Emery | 260/23 XA |
| 4,134,812 | 1/1979 | Sasaki et al. | 264/25 |
| 4,161,419 | 7/1979 | Alia | 156/51 |
| 4,163,031 | 7/1979 | Hannon et al. | 525/5 |
| 4,193,911 | 3/1980 | Fochesato | 260/45.7 P |
| 4,216,138 | 8/1980 | Bost et al. | 260/45.75 B |
| 4,238,384 | 12/1980 | Blumberg et al. | 260/37 R |
| 4,273,899 | 6/1981 | Saiki et al. | 525/439 |
| 4,295,886 | 10/1981 | Gresham | 106/18.19 |
| 4,366,270 | 12/1982 | Ruter | 523/307 |
| 4,366,279 | 12/1982 | Tomioka et al. | 524/289 |
| 4,391,941 | 7/1983 | Cotten et al. | 524/495 |
| 4,458,045 | 7/1984 | Mauric et al. | 523/351 |
| 4,471,080 | 9/1984 | Rinaldi et al. | 523/351 |
| 4,496,681 | 1/1985 | Lordi et al. | 524/371 |
| 4,510,271 | 4/1985 | Muhle et al. | 523/346 |
| 4,530,880 | 7/1985 | Taniuchi et al. | 524/371 |
| 4,532,165 | 7/1985 | Hashimoto et al. | 428/36 |
| 4,532,278 | 7/1985 | Hancock | 524/101 |
| 4,533,509 | 8/1985 | Gust et al. | 264/171 |
| 4,567,242 | 1/1986 | Nishibori et al. | 525/534 |

FOREIGN PATENT DOCUMENTS 55-5157636 5/1979 Japan .

OTHER PUBLICATIONS

Sahar Al-Malaika et al.: "Thermal Stabilisation of Polyolefins", *Degradation and Stabilisation of Polyolefins,* Normal Allen, Editor, 247-253, (1983).

*Primary Examiner*—Veronica P. Hoke
*Attorney, Agent, or Firm*—Jones, Askew & Lunsford

[57] ABSTRACT

There is disclosed a method for rendering fine denier polypropylene filaments and fibers flame retardant. The method includes mixing flame retardant compounds, such as an aromatic bromine and antimony oxide, with an anti-oxidant and low density polyethylene prior to mixing with the polypropylene resin.

20 Claims, No Drawings

FLAME RETARDANT POLYOLEFIN FIBER

RELATED CASE

This application is a continuation-in-part of our application Ser. No. 808,188, filed Dec. 12, 1985, now abandoned.

BACKGROUND OF THE INVENTION

This invention relates generally to flame retardant polyolefins, and more particularly concerns a method for mixing flame retardant compounds with polypropylene resins prior to extrusion and spinning to produce extruded fine denier filaments or fibers which are highly flame retardant and which exhibit good heat and color stability.

Widespread use of plastics in products for industry, commerce, and the household, has created the need to assure that such plastics are flame retardant. Polyolefins, for example, are highly flammable, and when used in the manufacture of fibers for clothing, upholstery, carpeting, and the like, the need for flame retardancy is even more apparent. It is, likewise, well recognized that polyolefin fibers used in upholstery and carpets have in the past increased the severity of fires in large commercial establishments by generating explosive gases. When the gases are ignited, the explosion can cause the fire to burst outside of the building and then chain link along the outside of the building from floor to floor.

As a result of the potential fire hazard created by the use of polyolefin fibers in materials, various governmental agencies and industrial societies have developed tests for determining the fire retardancy of materials made from various fibers. Five tests which are well recognized in the industry include:

(1) Motor Vehicle Interiors—MUSS-302;
(2) FAA Vertical Flammability, 14 C.F.R. 25-853(B);
(3) UFAC Cigarette Test Class II;
(4) Drapery and Curtain Fabrics—NFPA 701; and
(5) Tunnel Test—ASTME 84 (carpet).

In order to render materials containing polyolefin fibers flame retardant various fiber additives and finishing treatments have been proposed. With respect to additives, Hancock U.S. Pat. No. 4,532,278 discloses a fire retardant polypropylene fiber which results from combining the polypropylene polymer with a bromophenyl compound and which may include $C_{12}H_2Br_8O$; tetrabromobisphenol A; bis(2-hydroxyethyl ether) of tetrabromobisphenol A; and octabromobisphenyl oxide. The flame retarding compound, according to the Hancock, is simply blended into the polypropylene resin prior to or during extrusion.

Saiki et al. U.S. Pat. No. 4,273,899 discloses a process for forming a fire retardant thermoplastic polymer, specifically polyester, which process may involve multiple pelletizing steps in order to blend the fire retarding compound with the thermoplastic polymer. The resulting polyester is used in making injection-molded parts. The flame retardant compound is a medium molecular weight polymer of a carbonate of a brominated dihydric phenol having at least 16 recurring units optionally with an antimony compound.

While the prior art has addressed the problem of providing flame retardant polyolefin fibers and materials by the use of flame retarding additives, the prior art has not specifically addressed the particular problems which exist in rendering fine denier filaments of polypropylene flame retardant. Fine denier polypropylene fibers are manufactured by extruding the melted polypropylene resin through very fine nozzles or orifices of a spinneret. If the flame retardant compound is not completely mixed with the melted polypropylene resin prior to extrusion, the fire retardant compound tends to agglomerate onto itself, creating lumps in the extrusion melt which will clog the spinneret filters or orifices and will result in down time on a commercial line. In addition, smaller lumps of the flame retardant compound which can pass through the filter and spinneret die orifice will displace sufficient polymer in the resulting fine denier filament to create a weak spot in the continuous filament which may result in breakage that shuts down the production line. In addition, incomplete mixing of the flame retardant compound with the polypropylene resin may also have a deleterious affect on the ability of the flame retardant compound to generate cooling gases within a localized area which serve to render the material flame retardant.

SUMMARY OF THE INVENTION

It is therefore an object of the present invention to provide a process for completely mixing flame retardant compounds with polypropylene resin in order to extrude fine denier polypropylene filaments which exhibit a high degree of flame retardancy.

It is likewise an object of the present invention to provide a process for completely mixing flame retardant compounds with polypropylene resin in such manner and proportions as to assure that the fiber characteristics, except for flame retardancy, are not altered by the flame retardant compound.

It is also an object of the present invention to provide a process for completely mixing fire retardant compounds with polypropylene resin in such a manner and in such proportions as to assure that the fire retardant compounds do not react during the process so that they remain available to react in the case of a fire to provide the highest degree of fire retardancy.

Other objects and advantages of the invention will become apparent upon reading the following detailed description.

DETAILED DESCRIPTION OF THE INVENTION

While the invention will be described in connection with a preferred method and embodiment, it will be understood that we do not intend to limit the invention to that method or embodiment. On the contrary, we intend to cover all alternatives, modifications, and equivalents as may be included within the spirit and scope of the invention as defined by the appended claims.

It is well known in the art that aromatic halogens, when combined with antimony oxide in polymers, produces flame retardant characteristics in the polymers. Aromatic bromine compounds such as Pyro-Chek 77B, manufactured by Ferro Corporation of Bedford, Ohio are particularly useful in that regard. While the exact mechanism for flame retardancy is not fully understood, it is believed that the aromatic bromine and the antimony oxide in the presence of fire react with each other to produce a vapor which has a high heat of vaporization. The vapor literally absorbs the heat of the fire, reducing the temperature below the combustion point of the polymer, thereby snuffing out the fire. In order to assure the highest degree of flame retardancy, the aromatic bromine compound and the antimony oxide must be thoroughly mixed with the polypropylene so that in any given area of material made from the polypropylene, there will be sufficient aromatic bromine and antimony oxide to react to produce the flame retardant effect.

As previously indicated, the problem faced in producing flame retardant polypropylene yarns of fine denier results from the inability to mix the melted polypropylene with the flame retardant compounds and extrude the resulting melt. If the aromatic bromine and particularly the antimony oxide are not thoroughly mixed with the polypropylene resin, the two compounds, particularly the antimony oxide, will agglomerate on themselves, producing lumps in the mix which will result in clogging the spinneret filters or produce weak spots in the resulting continuous filament yarn. Such agglomerated lumps also necessarily produce other areas in which there will be a lack of aromatic bromine or antimony oxide, and thus reduced flame retardant effectiveness.

In order to produce a flame retardant fine denier polypropylene yarn at high spinning speeds, we have discovered that the aromatic bromine and antimony oxide will mix completely with the polypropylene resin if the aromatic bromine and the antimony oxide are first mixed with a carrier of low density polyethylene. The low density polyethylene serves as a lubricant and dispersion medium. The aromatic bromine and the antimony oxide disperse in the low density polyethylene, and as a result, the polyethylene functions as a carrier to hold the aromatic bromine and the antimony oxide in suspension so that those compounds will then completely disperse within the polypropylene resin. It should be understood that the dispersion cannot be accomplished by merely master batching the flame retardants in polypropylene. The polyethylene is necessary to assure complete dispersion.

By achieving complete dispersion of the flame retardant compounds, polypropylene fibers can be rendered flame retardant to the extent that they will, when formed into fabrics or carpets, pass the common flame retardancy tests previously identified while exhibiting only minor changes in their fiber characteristics.

The resulting fabrics may be further improved by dispersing an anti-oxidant along with the aromatic bromine and antimony oxide in the low density polyethylene. The thermal anti-oxidant provides heat stability to the aromatic bromine and antimony oxide and assures that the resulting fabric will resist yellowing and brittleness when exposed to high heat and humidity such as in upholstery fabric for automobiles.

Furthermore, the invention allows for high speed spinning from 200 to 1000 meters per minute of fine denier filaments ranging from 2 denier per filament (DPF) to 25 DPF. The invention which achieves the above results is carried out in accordance with the following illustrative examples in which aromatic bromine and antimony oxide are first mixed with low density polyethylene before being mixed with the polypropylene resin.

EXAMPLE 1

The preferred method of making the flame retardant polypropylene fibers of the present invention is carried out by the following steps:

(1) The following materials are dry-mixed by weight:

(a) Aromatic bromine compound (Pyro-Chek 77B): 3 parts (b) Thermal anti-oxidant—2,2-bis[[3-[3,5-bis(1,1-dimethylethyl)-4-hydroxyphenyl]-1-oxopropoxy]-methyl]-1,3-propanediyl 3,5-bis(1,1-dimethylethyl)-4-hydroxybenzenepropanoate (Irganox, manufactured by Ciba-Geigy of Ardsley, N.Y.): 0.1 part (c) Low density polyethylene (Rexene 207, manufactured by El Paso Natural Gas of El Paso, Tex.): 6 parts The mixture is then extruded through a compounding and pelletizing line to form a pellet. The extruder barrel has a temperature gradient of 150° C., 180° C., 200° C., and 220° C. along its length, and the dwell time of the mixture in the extruder barrel is 20 to 25 seconds. The extruder die has an opening of approximately $\frac{1}{8}$ inch in diameter, and the resulting extrusion is cut into $\frac{1}{4}$ inch lengths.

(2) The following materials are dry-mixed by weight:

(a) Antimony oxide: 1 parts (b) Thermal anti-oxidant (Irganox): 0.1 part (c) Low density polyethylene (Rexene 207): 2 parts The mixture is then extruded through a compounding and pelletizing line as described in step (1).

(3) The pellets formed by step 1 and the pellets formed by step 2 are then tumble-mixed in a ratio of approximately 3 parts pellets from step 1 to 1 part pellets from step 2. In order to assure complete tumble mixing, about 0.5% by weight of an anti-static agent, particularly ethylene oxide concentrate (Merpol ACS, manufactured by DuPont of Wilmington, Del.), is added during tumbling. The anti-static agent assures that the complete tumble mixing of the two pellets is not inhibited by the static electricity forces that build up as a result of the mixing itself. Once the tumble mixing has been completed, the resulting mixture is extruded through a compounding and pelletizing line having a temperature gradient of 150° C., 180° C., 200° C., and 220° C. with a dwell time in the extruder barrel of approximately 25 seconds. The resulting pellets formed from the extrusion process are approximately the same size as the pellets previously formed in steps 1 and 2.

(4) The pellets formed in step 3 are then metered into the polypropylene resin during the conventional fiber extrusion process at a ratio of 15 parts pellets from step 3 to 85 parts polypropylene resin. Appropriate coloring agents such as dyes or pigments may be added at this point if desired. We have, however, discovered that there is some tendency for the dyes to react and agglomerate with the flame retardants. Therefore, it is preferred to use pigments which have particles specified at less than 2 microns in diameter.

The final melt spinning extrusion is carried out in standard fashion on standard polypropylene spinning machinery. Such machinery is commercially available from various companies, including Plasticisers Engineering Limited of Bradford, England. The standard melt spinning process of step 4 can be carried out at spinning speeds of from 200 to 1000 meters per minute and at denier counts of 2 DPF to 25 DPF. The filaments are then gathered into yarn groups of 300 to 2600 total denier. Such yarn may then be woven or tufted into fabric such as curtains, drapes, mattress fabrics, bedding, upholstery, webbing, textile wall fabrics, carpets, rugs, and various industrial fabrics.

Particularly, three yarns were manufactured in accordance with Example 1, and the yarns were converted into the following test samples:

420 denier—mattress tape and luggage strap
740 denier—drapery and upholstery
2600 denier—textile wall covering and carpet.

For each of the above-identified products, a control sample was woven without the flame retardant additive.

Both the control and test samples were subjected to the following tests where applicable:

Test 1: Motor Vehicle Interiors—MUSS 302
Test 2: FAA Vertical Flamability 14 CFR 25-853(B)
Test 3: UFAC Cigarette Test Class II
Test 4: Drapery and Curtain Fabrics NFPA 701.

The following Table 1 summarizes the test results:

TABLE 1

| TEST | 1 | 2 | 3 | 4 |
|---|---|---|---|---|
| Mattress Tape | | | | |
| Control: | | Fail | | |
| Sample: | | Pass | | |
| Luggage Strap | | | | |
| Control: | | Fail | | |
| Sample: | | Pass | | |
| Upholstery Cloth | | | | |
| Control: | Fail | Fail | Fail | |
| Sample: | Pass | Pass | Pass | |
| Drapery | | | | |
| Control: | | Fail | | Fail |
| Sample: | | Pass | | Pass |
| Wall Covering | | | | |
| Control: | | Fail | | |
| Sample: | | Pass | | |

Based on the foregoing, we likewise believe that when carpet is manufactured from the yarn made in accordance with the present invention, it will pass the Tunnel Test ASTME 84 (class A).

While Example 1 above sets forth the preferred embodiment for carrying out the present invention, the invention can be carried out by mixing the aromatic bromine and antimony oxide first with each other and then subsequently with the low density polyethylene. Such process is carried out in accordance with Example 2 below.

EXAMPLE 2

(1) The following materials are dry-mixed by weight:
(a) Aromatic bromine (Pyro-Chek 77B): 3 parts
(b) Antimony oxide: 1 part The dry mixture is then pelletized in accordance with the pelletizing process of step (1) of Example 1.

(2) The pellets of step (1) are mixed with low density polyethylene by weight:
(a) Pellets of step (1): 4 parts
(b) Low density polyethylene (Rexene 207): 6 parts The mixture is then pelletized in accordance with the pelletizing process of step (1) of Example 1.

(3) The pellets of step (2) are mixed with a thermal anti-oxidant and more low density polyethylene by weight:
(a) Pellets of step (2): 10 parts
(b) Anti-oxidant (Irganox): 0.2 parts
(c) Low density polyethylene (Rexene 207): 2 parts The mixture is then pelletized in accordance with the process of step (3) of Example 1.

(4) The pellets of step 3 are metered into the polypropylene resin at a ratio of 15 to 85 during the spinning process to produce a flame retardant polypropylene fiber.

We claim:

1. A method for rendering fine polypropylene fibers flame retardant comprising:
a. dispersing fire retardant compounds in low density polyethylene by dry mixing, extruding, and pelletizing to form an additive pellet; and
b. mixing the additive pellet with polypropylene resin and extruding and spinning the fine polypropylene fibers therefrom.

2. The method of claim 1, wherein the flame retardant compounds comprise antimony oxide and an aromatic bromine compound.

3. The method of claim 1, wherein an anti-oxidant is dry-mixed with the fire retardant compounds and low density polyethylene prior to forming the additive pellet [2,2-bis[[3-[3,5-bis(1,1-Dimethyethyl)-4-hydroxyphenyl]-1-oxopropoxyl]methyl]-1,3-propanediyl 3,5-bis(1,1-dimethylethyl)-4-hydroxybenzenepropanoate].

4. The method of claim 3, wherein the flame retardant compounds and anti-oxidant are dispersed in the low density polyethylene in a ratio by weight of about 4 parts of flame retardant compounds, 0.2 part of anti-oxidant, and 8 parts of low density polyethylene and wherein the additive pellet is dry-mixed with the polypropylene resin in a ratio by weight of about 15 parts additive pellet to 85 parts polypropylene resin.

5. A method for rendering fine polypropylene fibers flame retardant:
a. dispersing an aromatic bromine compound in low-density polyethylene by dry mixing, extruding, and pelletizing to form a first pellet;
b. dispersing antimony oxide in a low-density polyethylene by dry-mixing, extruding, and pelletizing to form a second pellet;
c. combining the first and second pellets by dry-mixing, extruding, and pelletizing to form an additive pellet;
d. mixing the additive pellet with polypropylene resin and extruding and spinning fine polypropylene fibers therefrom.

6. The method of claim 5, wherein an anti-static agent is mixed with the first and second pellets during dry mixing in step (c) of claim 5.

7. The method of claim 6, wherein the anti-static agent is ethylene oxide concentrate and is added at a rate of 0.5% of the weight of the first and second pellets.

8. The method of claim 5, wherein an anti-oxidant is dry-mixed with the aromatic bromine compound and low density polyethylene prior to forming the first pellet and is dry-mixed with the anitmony oxide and low density polyethylene prior to forming the second pellet [2,2-bis[[3-[3,5-bis(1,1-Dimethyethyl)-4-hydroxyphenyl]-1-oxopropoxy]methyl]-1,3-propanediyl 3,5-bis(1,1-dimethylethyl)-4-hydroxy-benzenepropanoate].

9. The method of claim 8, wherein the aromatic bromine compound and anti-oxidant are dispersed in the low-density polyethylene in a ratio by weight of about 3 parts aromatic bromine compound, 0.1 parts anti-oxidant, and 6 parts low-density polyethylene, wherein the antimony oxide and anti-oxidant are dispersed in the low-density polyethylene in a ratio by weight of about 1 part antimony oxide 0.1 parts anti-oxidant, and 2 parts low-density polyethylene, wherein the first pellet and second pellet are mixed in a ratio by weight of about 3 parts of the first pellet and 1 part of the second pellet, and wherein the additive pellet is mixed with the polypropylene resin in a ratio by weight of 15 parts of the additive pellet and 85 parts of the polypropylene resin.

10. A method for rendering fine polypropylene fibers flame retardant comprising:

a. combining an aromatic bromine compound and antimony oxide by dry mixing, extruding, and pelletizing to form a first pellet;

b. dispersing the first pellets in low-density polyethylene by dry mixing, extruding, and pelletizing to form a second pellet;

c. adding an anti-oxidant to the second pellet by dry mixing the anti-oxidant, the second pellet, and polyethylene, extruding, and pelletizing to form an additive pellet; and d. mixing the additive pellet with polypropylene resin and extruding and spinning the fine polypropylene fibers therefrom.

11. The method of claim 10, wherein about 3 parts by weight of aromatic bromine compound are mixed with about 1 part by weight of antimony oxide, about 4 parts by weight of the first pellets are mixed with about 6 parts by weight of low density polyethylene, about 10 parts by weight of the second pellet are mixed with about 0.2 parts by weight of the anti-oxidant and about 2 parts by weight of low density polyethylene, and about 15 parts by weight of the additive pellet are mixed with about 85 parts by weight of the polypropylene.

12. Polypropylene fibers made in accordance with claim 1.

13. Polypropylene fibers made in accordance with claim 5.

14. Polypropylene fibers made in accordance with claim 6.

15. Polypropylene fibers made in accordance with claim 9.

16. Polypropylene fibers made in accordance with claim 10.

17. Polypropylene fibers made in accordance with claim 11.

18. The method of claim 3, wherein the anti-oxidant is 2,2-bis[[3-[3,5-bis(1,1-dimethylethyl)-4-hydroxyphenyl]-1-oxopropoxyl]methyl]-1,3-propanediyl 3,5-bis(1,1-dimethylethyl)-4-hydroxybenzenepropanoate.

19. The method of claim 8, wherein the anti-oxidant is 2,2-bis[[3-[3,5-bis(1,1-dimethylethyl)-4-hydroxyphenyl]-1-oxopropoxyl]methyl]-1,3-propanediyl 3,5-bis(1,1-dimethylethyl)-4-hydroxy-benzenepropanoate.

20. Polypropylene fibers made in accordance with claim 4.

* * * * *